US005322581A

United States Patent [19]

Heerten et al.

[11] Patent Number: 5,322,581

[45] Date of Patent: Jun. 21, 1994

[54] JOIN IN THE OVERLAPPED ZONE OF NEEDLE PUNCHED BENTONITE SEALING SHEETS

[75] Inventors: Georg Heerten, Lübbecke; Volkard Müller, Petershausen-Masslingen, both of Fed. Rep. of Germany

[73] Assignee: Naue-Fasertechnik GmbH & Co. KG, Fed. Rep. of Germany

[21] Appl. No.: 905,528

[22] Filed: Jun. 29, 1992

[30] Foreign Application Priority Data

Jul. 11, 1991 [DE] Fed. Rep. of Germany ..... 4122992

[51] Int. Cl.[5] ..... B32B 5/06

[52] U.S. Cl. ..... 156/148; 28/107; 428/192; 428/284; 428/300

[58] Field of Search ..... 428/192, 300, 284; 156/148, 306.6; 28/107

[56] References Cited

U.S. PATENT DOCUMENTS

| | | | |
|---|---|---|---|
| 5,041,330 | 8/1991 | Heerten et al. | 428/300 |
| 5,171,629 | 12/1992 | Herdel et al. | 428/300 |
| 5,174,231 | 12/1992 | White | 428/300 |
| 5,221,568 | 6/1993 | Heerten et al. | 428/300 |

*Primary Examiner*—James J. Bell

*Attorney, Agent, or Firm*—Larson and Taylor

[57] ABSTRACT

Water- and/or oil-tight bentonite sealing sheets or mats are produced which after laying have a water-tight and frictional interconnection or joint in the overlapped part thereof. This is achieved by filling the pore space in the overlapped zone with bentonite and following in situ needle punching of the overlapped zone or with bitumen or synthetic resin systems, optionally filled with bentonite, and later bonding or welding of the overlapped zone. It is also possible to weld the overlapped zone together as "films" and, then to bond or weld such zones.

10 Claims, 2 Drawing Sheets

JOIN IN THE OVERLAPPED ZONE OF NEEDLE PUNCHED BENTONITE SEALING SHEETS

The conventional sealing sheets are manufactured in such a manner that firstly a layer of dry, swellable bentonite is arranged on the substrate layer and on it the covering layer is placed and finally all three layers are needle punched in a needle punching machine.

Sealing sheets produced in this manner are normally 4.5 m in width and 30 m in length and are delivered as rolls at the constructional site The bentonites used as a layer of swellable clay are clays with a moderate to high content of smectite (as montmorillonite), which have a substantial influence on the relevant properties (high swelling capacity, substantial capacity to bind water and high degree of plasticity). In order to produce a highly active bentonite from an alkaline earth bentonite with a low swelling capacity in water, the alkaline earth ions of the bentonite are replaced by alkali metal ions and preferably sodium ions. Therefore "highly swellable" active sodium bentonite with its considerably enhanced plasticity, viscosity, thixotropy and water absorbing capacity is preferred. It is more particularly preferred to use naturally occurring sodium bentonites such as those from sources in Wyoming, USA.

The procedure for the laying of such sheets is such as to ensure a marginal overlap of 30 to 50 cm. In this respect it is established practice to carefully caulk the overlapping zone with bentonite powder and/or bentonite paste. For this purpose a 10 cm wide and approximately 1 cm thick band of paste bentonite powder or bentonite paste is arranged on the fattened, unrolled web of sheeting at a distance of approximately 30 cm from the edge. The bentonite powder may for instance be applied with a spreading carriage. The paste may be troweled on by hand or using a pump with a suitably configured nozzle. After this the next web of sheeting is laid with overlap.

The spread bentonite powder or, respectively, the applied bentonite paste not only functions to seal off the cavity between the overlapping part but also a part of the powder or paste penetrates into the opposite non-woven textile material. It has been established in field and lab tests that this method of joining in the overlap range leads to a coefficient (k) of water permeability of approximately $5 \cdot 10^{-9}$ m./sec. Since the sealing sheet itself has a coefficient of water permeability of less than $10^{-10}$, one object of the present invention is to develop a method of jointing, which seems potentially likely to lead to coefficients of impermeability to water adjacent to the overlap of the same order as the body of the sheet itself. A disadvantage found with joining methods so far used is that on slopes or also when loading the sheet with the layers of earth necessary for weighing down the sheet on a horizontal surface there may be a mutual displacement of the sheet with the formation of folds in the overlapped zone. Accordingly a still further object of the invention is to so improve upon methods so far used for joining bentonite sheets as described in the above that overlap zone constitute a frictionally joined unit so that no displacement of the layers of the non-woven textile material is possible in the overlap zone.

SUMMARY OF THE INVENTION

In order to achieve these and/or other aims appearing herein, in accordance with the invention three different procedures may be adopted, that is to say:

(a) using a mobile needle punching device to needle punch the overlap zone, provided with the bentonite powder or paste, in situ on the constructional site, in which respect on the one hand a frictionally joined unit is produced between the non-woven textile material layers opposite to the overlap zone and on the other hand so much bentonite is needle punched into the pore interstices of the mutually opposite non-woven textile material layers that such non-woven textile material zone present a satisfactory degree of impermeability to water of the same order of size as the water impermeability of the sealing sheeting itself, or (b) by filling all pore spaces tn the overlapping non-woven textile material layers with bitumen or with an all weather synthetic resin which is resistant to weathering and soil bacteria, in which respect bitumen or synthetic resin may be mixed with bentonite, in situ on the constructional site or in the factory, and then welding or bonding such completely filled non-woven textile material zones with an all weather adhesive which is resistant to weathering and soil bacteria to give a frictionally joined structure, in which respect in the case of in situ impregnation of the marginal parts the bitumen or synthetic resin systems, optionally mixed with bitumen are bonded simultaneously in the overlapped zones of the non-woven textile material, or (c) by either fusing together the non-woven textile material parts of the sealing sheeting which eventually constitute the overlapped parts, on one or both sides to form "films" in the factory and bonding or welding them after laying on the constructional site by fusing together, in one single operation, the opposite layers of the non-woven textile material in the overlap zone then constituting "films" and immediately thereafter welding them together by following compression to join them together with a loading effect.

BRIEF DESCRIPTION OF THE DRAWINGS

The invention will be described below with reference to FIGS. 1 through 5 in more detail without limiting its scope.

DETAILED DESCRIPTION OF THE PREFERRED EMBODIMENTS

Figure 1:
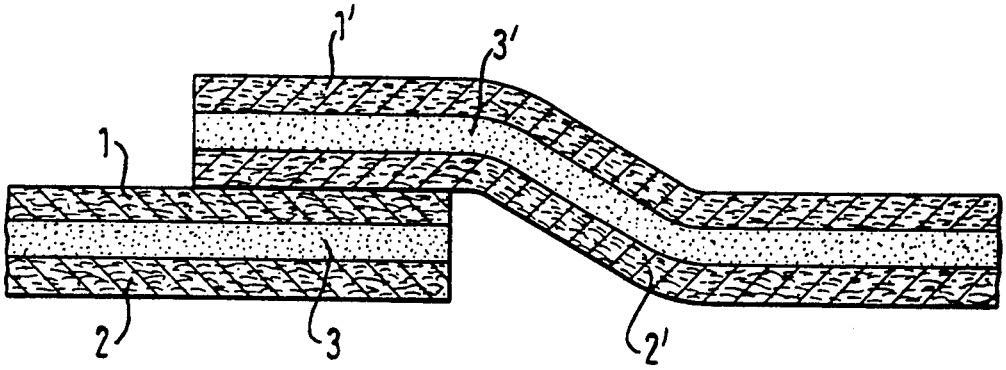
FIG. 1 shows in cross section the overlap zone between two bentonite sheets
Figure 2:
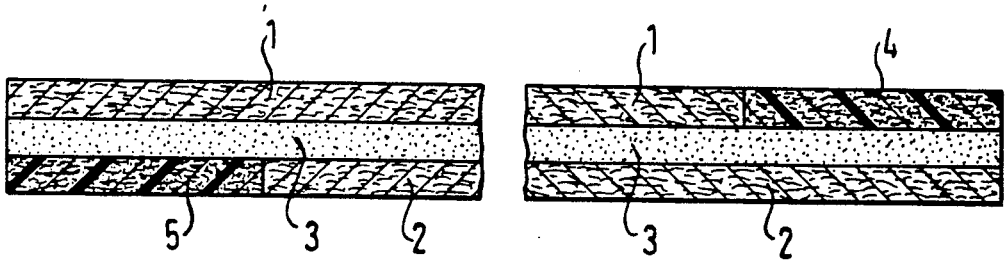
FIG. 2 is a cross section showing the left and the right side of a bentonite sealing sheet processed in accordance with the invention.
Figure 3:
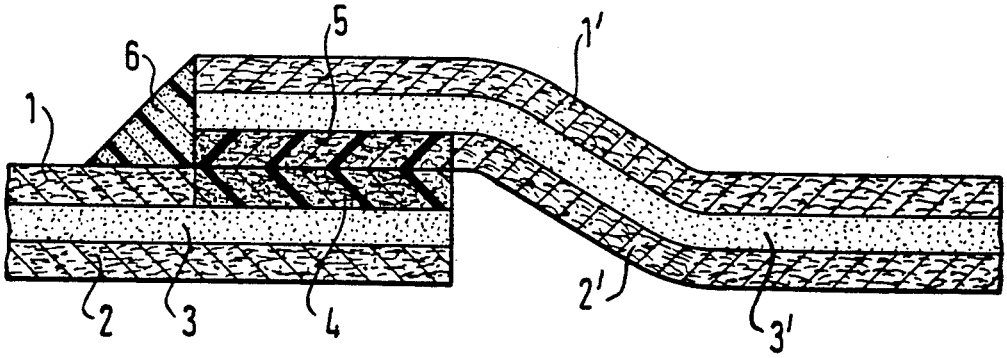
FIG. 3 is a diagrammatic cross section showing of the overlap part of two bentonite sealing sheets processed in accordance with the invention.

The sealing sheets illustrated in FIGS. 1 through 3 consist of the covering layer 1, and 1', the substrate layer 2 and 2' and the bentonite layer and 3' which is arranged between the substrate and covering layers. In the overlap zone the non-woven textile material layers 2, 1, 2' and 1 are arranged on top of each other. As will be seen from this representation, it is possible for water to penetrate into the subsoil through the overlapping parts of the non-woven textile material layers 1 and 2' if the layers are not treated. In order to prevent this happening a bentonite powder or a bentonite paste is incorporated in the overlap zone between the layers of non-woven textile material 1 and 2' (not illustrated in FIG. 1) whereafter the overlap zone is needle punched on the constructional site. This mobile needle punching device consists essentially of a slide plate, provided with a push and pull rod, and simultaneously functioning as perforated plate (that is to say a stripper plate), on which plate a holding and guiding device is arranged for the needle carrier which moves upwards and downwards, which may also be moved by means of a suitable eccentric shaft acting via a drive device mounted on the slide plate, vertically upwards and downwards, there being no lower perforated plate (piercing plate) as otherwise conventionally used in stationary needle punching machines. The needle plate of such a mobile needle punching device is as well fitted with two different types of needle, the one type of needle having downwardly directed barbs and the other type having upwardly pointing barbs. In place of these two different types of needles or additionally thereto it is possible for the needle plate to be fitted with special or customized needles, so-called twin function needles which have barbs of which one part is directed downwards and the other part is directed upwards, a maximum number of barbs being arranged adjacent to the needle tips.

Owing to such needle punching with the mobile needle punching machine it is possible to achieve not only a friction joint of the layers 1 and 2' of non-woven textile material but furthermore a sealing of such zones 1 and 2' of non-woven textile material by means of bentonite particles penetrating into these pore spaces of the non-woven textile material layers.

Another possibility of producing a frictional and water-tight connection in the overlapped zone resides in filling the pore spaces present in the zones 1 and 2' of the non-woven textile material with a synthetic resin (or a synthetic resin-bentonite mixture) which is insensitive to the effects of temperature within a wide temperature range and is resistant to rot. In this respect the procedure may be such for instance that a sealing sheet is sealed or welded at the left longitudinal edge within the layer 2 of the non-woven textile material and on the right longitudinal edge the upper covering layer 1 is put in place so that the sealed zones 4 and, respectively, 5 are produced as shown in FIG. 2.

During laying the member 4 will constitute the part of the sealing sheet overlapping the edge 5 of a second sealing web, For additional sealing it is possible additionally at the end edge of the top overlapping non-woven textile material web for the zone referenced 6 in FIG. 3 to be filled with a silicone and/or another adhesive synthetic resin, such sealing operation being able to be so performed that the sealing composition simultaneously additionally penetrates the lower non-woven textile material layer 1 as far as the bentonite layer 3. This procedure is more particularly suitable if additional safety is desired as regards impermeability to water of the overlapped part, which has been joined by needle punching and by the incorporation of an intermediate layer of bentonite powder or bentonite paste into the intermediate space between the overlapped non-woven textile material parts 1 and 2'.

Figure 4:
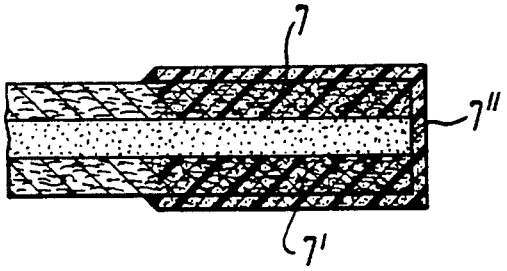
FIG. 4 is a diagrammatic cross section of the edge formed in the later overlap zone of a sealing sheet, which is sealed on either side and on the end edge with synthetic resin or with a synthetic resin-bentonite mixture.

In the case of laying the sheets as shown in FIG. 2 whose marginal parts 4 and 5 have been sealed by the manufacturer, it is naturally necessary to take care to see that the parts 5 and 4 are in fact superposed. In order to avoid errors in this connection it has been found an advantage to seal the entire marginal part with synthetic resin as shown in FIG. 4 so that penetration or impregnation of the non-woven textile material part 7 and 7' including a sealing of the end edge 7' is performed. In the case of this "capping" of the edges it is not necessary for the entire non-woven textile material part as far as bentonite layer to be filled with synthetic resin, since after bonding the respective opposite edge parts in the overlapped zone it is no longer possible for any water to pass through the overlapped zone. This capping may be performed by welding on one film strip on top and underneath in the zone 7 and 7', the end 7'' being simultaneously sealed or closed.

Figure 5:
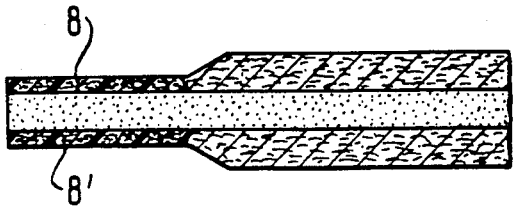
FIG. 5 is a diagrammatic showing in cross section of the later overlap zone, in the case of which the two layers of non-woven textile material are fused together to constitute a single film.

A further possibility for producing an edge zone on the sealing sheets and which leads later to a water-tight and frictional joint in the overlapping zone is as illustrated in FIG. 5, in the case of which the non-woven textile material zones constituting the margins have been fused together as a water-tight film or sheet. The film zone may then be overlappingly bonded or welded to a sealing sheet of the same type.

Synthetic resin systems which may be utilized for filling the pore space in the overlapping non-woven textile material parts are preferably reactive synthetic resin systems, and more particularly polyurethane and epoxy systems, swelling weld pastes, as for instance on the basis of polybutadiene, aqueous synthetic resin dispersions, for instance on an acrylate basis (Acronal products of the BASF Company) and hot melt and fusion adhesives. In a similar manner it is possible to use customized grades of bitumen. Both the above mentioned synthetic resin systems, including the adhesives, and also the different grades of bitumen, are preferably blended with bentonite, this more particularly applying for the polyurethane systems, which are blended with bentonite in weight ratio of polyurethane system to bentonite of 1:1 to 5:1.

Dependent on the degree of viscosity of the synthetic resin or bitumen systems utilized, which are optionally filled with bentonite, such systems either penetrate the pore spaces on their own or they may be forced into the spaces by suitable pressing rolls or other devices, it then being simultaneously possible to produce a reduction of the volume of the non-woven textile material in the overlapped zone.

In a similar manner it is possible to compact the non-woven textile material layers as well by pressing together the overlapped zones of the non-woven textile material by means of hot rolls or other devices to give rise to water-tight film-like sheets.

We claim:

1. A method for producing a water-tight frictional joint in the overlapped zone between sealing sheets which consists essentially of two layers of non-woven textile material, namely a covering layer and a substrate layer, and an intermediate bentonite layer therebetween, these three layers being needle punched together, the sheets having opposed edges which in use overlap with edges of other sheets in the said overlapped zone, comprising the steps of:

using a mobile needle punching device to needle punch the overlapped zone after it has been provided with bentonite powder or paste, in situ on the construction site, to provide a frictionally joined unit between the non-woven textile material layers opposite to each other at the overlapped zone, wherein during the needle punching step sufficient bentonite is needle punched into the pore interstices of the mutually opposing non-woven textile material layers that such non-woven textile materials have a satisfactory degree of impermeability to water on the same order of magnitude as the water impermeability of the sealing sheets themselves.

2. A method according to claim 1, wherein the in situ needle punching operation is performed on the construction site with a mobile needle punching machine which comprises a slide plate having a push and pull rod and simultaneously functioning as a perforated plate, on which plate a holding a guiding device is arranged for the needle carrier which moves upwards and downwards, there being no lower perforated plate.

3. A method according to claim 2, wherein the needle punching step comprises simultaneously fitting the needle plate of the mobile needle punching device with two different types of needles, one type of needle having downwardly directed barbs and the other type having upwardly directed barbs.

4. A method according to claim 3, wherein the needle punching machine utilized to perform the needle punching has a needle plate in which, in addition to having two different types of needles, is fitted with twin function customized needles which have barbs in one part which are directed downwards and in another part directed upwards, a maximum number of barbs being arranged adjacent to the needle points.

5. A method for producing a water-tight frictional joint in the overlapped zone between sealing sheets which consists essentially of two layers of non-woven textile material, namely a covering layer and a substrate layer, and an intermediate bentonite layer therebetween, these three layers being needle punched together, the sheets having opposed edges which in use overlap with edges of other sheets in the said overlapped zone, comprising the steps of:

filling essentially all pore spaces in the overlapping non-woven textile material layers with bitumen or with an all weather synthetic resin which is resistent to weathering and soil bacteria, in which respect bitumen or synthetic resin may be mixed with bentonite, and then welding or bonding such filled non-woven textile material layers with an all weather adhesive which is resistent to weathering and soil bacteria to provide a frictionally joined structure, wherein the bitumen or synthetic resin systems, optionally mixed with bitumen are bonded simultaneously in the overlapped zones of the non-woven textile material.

6. The method of claim 5, wherein the synthetic resin system is a polyurethane or epoxy system or such a system mixed with bentonite.

7. The method as claimed in claim 5, wherein an aqueous synthetic resin dispersion simultaneously impregnates and bonds the overlapped non-woven textile material zones.

8. A method according to claim 5, wherein after bonding, welding or needle punching of the overlapped zone, the upper edge of the overlapping sealing sheet is sealed with synthetic resin which is preferably in the form of a silicone.

9. A method for producing a water-tight frictional joint in the overlapped zone between sealing sheets which consists essentially of two layers of non-woven textile material, namely a covering layer and a substrate layer, and an intermediate bentonite layer therebetween, these three layers being needle punched together, the sheets having opposed edges which in use overlap with edges of other sheets in the said overlapped zone, comprising the steps of:

fusing together the non-woven textile material parts of the sealing sheet which constitute the overlapped parts, on one or both sides to form films, and then bonding or welding them after laying them on the construction site by fusing together, in one single operation, the opposite layers of the non-woven textile material in the overlapped zone and immediately thereafter welding them together with compression to join them together under load.

10. A method according to claim 5, wherein the synthetic resin is in the form of a swelling welding paste for the simultaneous impregnating and bonding of the overlapped zones.

* * * * *